US005296686A

United States Patent [19]

Ullrich et al.

[11] Patent Number: 5,296,686

[45] Date of Patent: Mar. 22, 1994

[54] HEATING ELEMENT

[75] Inventors: Christian Ullrich, Bad Homburg, Fed. Rep. of Germany; John A. Winterburn, Dumfries, Great Britain

[73] Assignee: Thermal Quartz Schmelze GmbH, Fed. Rep. of Germany

[21] Appl. No.: 590,245

[22] Filed: Sep. 28, 1990

[30] Foreign Application Priority Data

Sep. 28, 1989 [FR] France ..... 89 12683

[51] Int. Cl.[5] ..... H05B 3/40; H05B 3/10

[52] U.S. Cl. ..... 219/553; 392/424; 392/407; 219/534

[58] Field of Search ..... 338/267, 268, 234–237; 392/407, 424, 408, 423, 464; 219/553, 461, 464, 534, 523; 313/252, 256, 271, 274, 275, 277, 276, 279

[56] References Cited

U.S. PATENT DOCUMENTS

| | | | |
|---|---|---|---|
| 1,858,483 | 5/1932 | Conrad | 338/237 |
| 2,614,200 | 10/1952 | McNair | 219/523 |
| 2,913,565 | 11/1959 | Von Kantzow | 219/464 |
| 3,313,921 | 4/1967 | Mohn et al. | 219/523 |
| 3,560,705 | 2/1971 | Mendenhall | 219/512 |
| 3,627,989 | 12/1971 | Heidler | 219/464 |
| 3,691,346 | 9/1972 | Dyre et al. | 219/553 |
| 3,699,309 | 10/1972 | Eck | 219/553 |
| 3,930,178 | 12/1975 | Coaton | 313/275 |
| 4,001,622 | 1/1977 | Howell | 313/113 |
| 4,119,832 | 10/1978 | Audesse et al. | 219/270 |
| 4,483,304 | 11/1984 | Yokoi et al. | 219/543 |
| 4,531,047 | 7/1985 | Canfield et al. | 219/354 |

FOREIGN PATENT DOCUMENTS 1380190 of 1964 France .

*Primary Examiner*—Bruce A. Reynolds
*Assistant Examiner*—Michael D. Switzer
*Attorney, Agent, or Firm*—Pennie & Edmonds

[57] ABSTRACT

A heating element having at least one filament. The filament(s) are supported by an insulating trough which reflects heat and insulates a rear wall of a refractory tube within which said trough is mounted. The element may incorporate a metal rod located within, and substantially parallel to a longitudinal axis of the insulating trough. The metal rod enables an external electrical connection to be made with the filament(s) at one end only of the heating element such that all external connections to the outside power source may be made at the opposite end of the heating element.

26 Claims, 2 Drawing Sheets

HEATING ELEMENT

FIELD OF THE INVENTION

The invention relates to heating elements and more particularly to heating elements of a type which comprise incandescent metal resistors mounted within a tube which is nearly transparent to the radiation emitted.

BACKGROUND OF THE INVENTION

Heating elements commonly utilize metal resistors containing iron, chromium and aluminum alloys. These resistors are commonly constructed in a helical form and are mounted within a tube formed of quartz, vitreous silica, or vitrified ceramic composition.

Heating elements such as those described above have many uses in industry. They are, in particular, very widely used for drying papers, fabrics, paints, wood, agglomerated or stratified plates and panels and various granulates. Frequently they are installed in heating containers, wherein they are typically arranged parallel to one another in front of a reflecting metal plate.

Radiant heating elements in which the active element comprises a helical resistor exposed to air, have a limited operating temperature, e.g., 1000° C. The mechanical resistance of the metal alloy used in the resistor, the effects of oxidation, and the desired wavelength of operation all restrict the operating temperature. An extreme operating temperature is associated with short wavelength emission, and thus the medium wavelength is the desired energy form. Since lower operating temperatures are used to produce medium wavelength radiation, in order to produce enough thermal energy for practical use it is desirable to utilize several resistor filaments positioned parallel to one another. Most commonly, two such resistors are utilized.

Moreover, it is common to install the two resistors parallel to each other in a single tube, such as a silica based tube. Two methods have been utilized in the prior art for separating two resistors housed within the same tube. In the first method, the tube was divided into hemi-sections (i.e., with a cross-section shaped like the figure "8") by a septum running the length of the tube. In a second method, a second, smaller tube is placed as an insulator through the center of the main tube. This tube may, for example, be formed from the same material as the main tube.

One problem with the use of the first method is the necessity of utilizing electrical connections at both ends of the tube. The second system, by contrast, could allow sufficient room between the smaller tube and the wall of the main tube to permit such a connection at the ends of both resistors. It is also possible to pass an electric cable through the smaller tube so as to make a connection with the resistors at the end of the main tube and thus to obviate the need for electrical connections at either end of the heating element. However, even though it might be possible to utilize a form of tube within a tube design to gain a single end electrical connection heating element, the system has the drawback of creating a vibratory phenomena during actual operation.

Depending on the characteristics of each filament, such as diameter, length, temperature, and wavelength, it may be advantageous to supply electrical power to two resistors in either a parallel or a series circuit configuration. In the prior art embodiment discussed above having a cross-section shaped like the figure "8", it will be necessary to make connections to the heating element at either end of its tube. Junction boxes can be connected to the filaments at either end of the tubes to allow either series or parallel configuration.

If the heating element design utilized is the small tube within the main tube embodiment, it might be possible to make all electrical connections from one end of the tube only by passing a connecting wire behind the smaller tube in order to connect to the ends of the resistors distal to the electrical terminus of the heating element. The disadvantage to this arrangement is that once the heating element is configured for either parallel or series circuitry, changing the configuration requires disassembly of the heating element. There are no known heating elements in the prior art comprising a heating element tube with all the electrical connections at one end only, in which the configuration of multi-resistors within the element could be changed easily without the need to disassemble the heating element.

In the prior art, heating elements utilizing the vitreous silica tubes described above have been provided with a thin layer of gold on their rear face. This technique effectively diminishes the amount of thermal radiation released at the rear aspect of the heating element. This technique has been less than satisfactory, however, in that the gold layer is mechanically fragile and its presence necessarily limits the operating temperature of the heating element. If any overheating of the silica/gold interface occurs i.e., if the temperature exceeds 800° C., the gold layer becomes virtually useless and no longer exerts any effect upon the radiation. Furthermore, prior to the installation of the heating element tube, the gold layer is extremely susceptible to mechanical damage. Moreover, utilizing gold in a heating element also significantly adds to the expense associated with this item.

Other means have been used in the past for reflecting and concentrating radiation emitted by the incandescent filaments of heating elements. U.S. Pat. No. 4,001,622 discloses, for example, a high-temperature linear filament of tungsten placed eccentrically towards a rear wall of a circular tube of quartz and parallel to the tube axis. The tube itself is embedded in a coaxial semi-cylinder of ceramic fibres in such a manner as to focus the radiation along a straight line parallel to the axis on the other side of the filament, outside the tube. This design, which is well adapted to photocopying technology, is not suited, however, to precise positioning of multiple heating filaments. This design also lacks the utility of a one end only electrical connection design utilized in a heating element. It also lacks the versatility of simple selection of series, or parallel electrical configuration.

Both the ceramic fibre design of U.S. Pat. No. 4,001,622, and the existing gold reflector technology result in unnecessary heating of the wall of the tube proximate to the gold or ceramic layer. Radiation traverses this wall once upon initial emission, and again at reflection thus reducing the rigidity of the tube wall and lowering the thermal efficiency of the system.

SUMMARY OF THE INVENTION

Now in accordance with the present invention a tubular heating element has been devised that utilizes electrical connections to a power source at only one end of the element, precisely fixes the position of one or more filaments in relation to a refractory tube, and allows simple selection of a series or parallel electrical configuration when two or more filaments are utilized.

The tubular heating element of the present invention comprises a refractory tube, a trough located within the tube defining at least one recessed portion extending parallel to the trough's longitudinal axis and traversing substantially the entire length of the trough, said trough formed of a heat reflecting, thermally insulating material of such dimensions that the trough is able to fit within the refractory tube. The element of the invention additionally comprises at least one incandescent filament fixed within the recessed portion.

The tubular heating element operates by the principal of re-emission. The thermal energy emanating from the incandescent filament, at least some of which is reflected by the trough means, is directed to an inside surface of the refractory tube not in contact with the trough means. Some of the thermal energy passes directly through the refractory tube without any change in wavelength. However, another portion of the thermal energy is absorbed by the refractory tube, and then re-emitted at a longer wavelength.

In the present invention, the trough means reflects substantially all the radiant energy directed toward it from the filament(s) to all the inside surfaces of the refractory tube not in contact with the trough means. The surface area of the inside surface of the refractory tube not in contact with the trough means is maximized, thus optimizing the inner surface area of the refractory tube available for emission and re-emission of energy. The addition of longer (i.e. re-emitted) wavelength radiation increases the utility of the present invention in many industrial applications that require broader ranges of emission.

In a further embodiment the tubular heating element of the invention may additionally comprise a metal rod electrically insulated from the incandescent filament(s), said metal rod being located within the trough and extending beyond the trough at both the trough's terminal ends.

The subject tubular heating element may further include two parallel recessed portions, with each said recessed portion providing a recess for a filament in such a manner as to electrically insulate one filament from the other. The heat reflecting, thermally insulating material of which the trough is formed has a thermal conductivity of less than 0.35° C. The trough may be formed of ceramic fibres of silica, alumina, or a combination of both. A trough comprised of ceramic fibres of silica may be slip cast.

In one embodiment of the present invention, the metal rod may be connected at one end to at least one filament as an internal connection, leaving one or more free ends at the opposite end of the filament(s), and a free end of the metal rod. The free end of the metal rod may be connected to one polarity of an electrical source, while the one or more free ends of the filaments may be connected to the other pole of the electrical source, thus resulting in a parallel filament circuit arrangement. Conversely, the free end(s) of the filament(s) may each be connected across opposite polarities of an electrical source so as to result in a series circuit arrangement.

DESCRIPTION OF THE PREFERRED EMBODIMENTS

The present invention is a heating element comprising a refractory tube, within which a trough with a reflecting surface is located. One or more recessed portions traverse the length of the trough parallel to its long axis. Within each trough is located a filament which, through its location within the recessed portion on a reflecting surface of the trough, is electrically insulated from any other filament. The refractory tube may be comprised of any suitable material such as for example, vitreous silica. The trough portion is comprised of a thermally insulating, heat-reflecting, refractory material.

The material utilized to form the trough portion of the present invention has a thermal conductivity at 1000° C. of less than 0.35 $Wm^{-1}K^{-1}$ and preferably less than 0.25 $Wm^{-1}K^{-1}$. The trough may be formed for example of silica obtained from a slip by the process of "slip-casting", which is well known in the prior art, or of ceramic fibres based upon silica and/or alumina. The shape of the trough according to the present invention must be such that it simplifies the introduction of a trough-filament assembly into the refractory tube. The shape of the recessed portions along the trough must be such as to precisely accommodate the filament they house.

A ceramic fibre material or porous silica can be utilized in fabricating the trough. The porous silica is a silica that is used in slip-cast techniques. This type of silica has an especially high spectral reflectance, of the order of 85% for wavelengths exceeding 0.8 u. Where the trough is made of refractory fibre, ceramic fibre based upon alumina and silica may advantageously be used, such as for example that sold under the trade mark KERLANE-Pyronappa 50. To obtain the shape of the trough, a mineral binder based upon silicates will preferably be used.

It is very important that the thickness of the trough wall closest to the rear tube surface not be too thin. With the fibres described above, the conductivity at 1,000° C. is of the order of 0.2 $Wm^{-1}K^{-1}$. A thickness on the order of 4 millimeters at the thinnest point has proved satisfactory.

The filament(s) located within the recessed portion(s) of the trough may be composed of any suitable alloy. For example, alloys of iron, chromium and aluminum may be utilized. These filaments preferably have a helical design.

One embodiment of the invention provides for the installation of a metal rod within the trough. This metal rod serves to conduct electrical current to an internal connection end of the refractory tube opposite an electrical supply terminal end. This element of the invention greatly enhances its utility by allowing a single end electrical connection to an outside power source.

Figure 3:
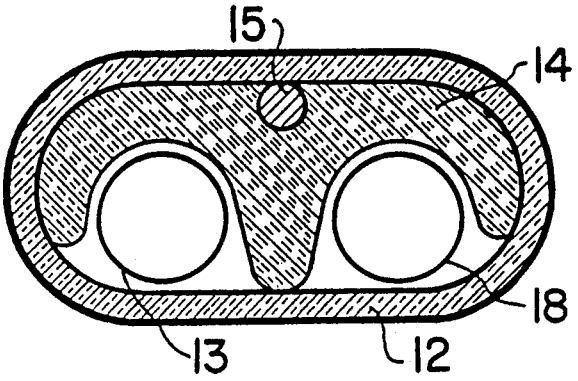
FIG. 3 illustrates one embodiment of the present invention comprising a trough element within a refractory tube for electrically isolating two filaments.
Figure 4:
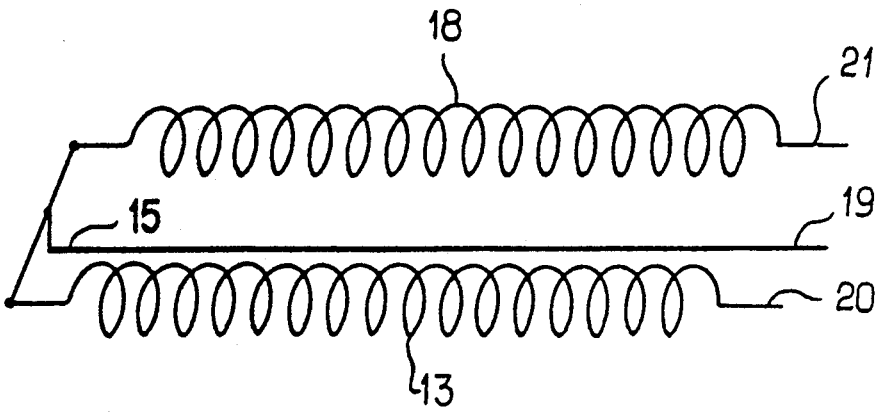
FIG. 4 is an electrical circuit diagram of one embodiment shown in FIG. 3.

In FIG. 4 is a schematic diagram of one embodiment of the present invention illustrated in FIG. 3. In this embodiment two filaments are utilized. Free ends of the filaments are indicated as 21 and 20 on the diagram. If power is supplied across these free ends, the filaments will be positioned in a series circuit. If, however, a free end of the metal rod 15 is receiving one polarity of a power source, while the free ends of the filaments are both receiving current from the other polarity, the two filaments will be in a parallel circuit.

FIG. 3 illustrates an embodiment of the present invention whose electrical circuitry is shown in FIG. 4. An oval heat tube element 12 houses a trough element 14 which is comprised of a heat reflecting, thermally insulating material. A filament 13 is shown isolated from a second filament 18 by means of two recessed portions in the trough. Each filament is located on a forward facing surface of the trough so that radiant energy directed towards the trough's heat reflecting surface will be redirected forward through a front surface of the tube. An electrical rod 15 is illustrated passing within the body of the trough as a means of providing an electrical connection with the filaments from one end only of the tube.

Heating elements of the type described herein are utilized for both household and industrial use. Typically, these heating elements are used for the drying, cooking, polymerizing, calcining and roasting applications commonly encountered, and the broadest range of radiation is desired; ideally, 1.5 to 10u. The phenomenon of re-emission allows wide radiation wavelength from the 2.7u source of a heated alloy filament typically utilized in heating element tubes. During this process a certain portion of the radiation crosses through the vitreous tube unchanged, but a certain amount of radiation heats the tube face which thereafter re-emits radiation of a longer wavelength. Since radiation emission is often desired in a given direction, rather than as an omni-directional flow, the gold layer techniques and the ceramic co-axial tube techniques were in the past utilized.

Figure 1:
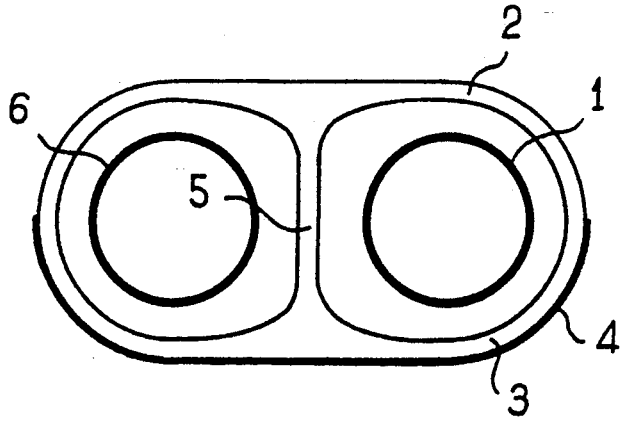
FIG 1 Prior Art
FIG. 1 illustrates a conventional prior art heating element, comprising two filaments electrically isolated by an internal wall.
Figure 2:
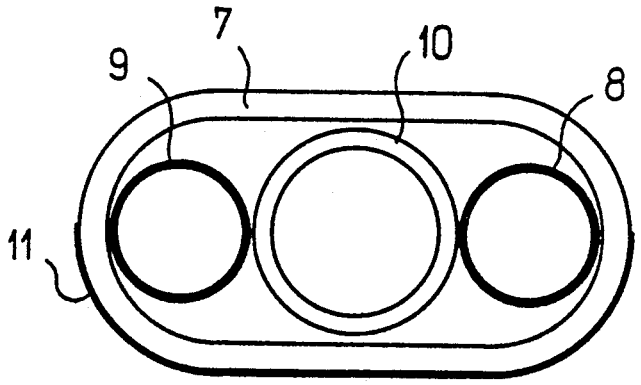
FIG 2 Prior Art
FIG. 2 illustrates an alternate type of prior art heating element comprising a small inner tube within an outer heating element tube for electrically isolating the two filaments.

The two major methods of reflecting and insulting rear walls of heating elements used in the prior art permit radiant energy to pass through a vitreous silica, or other refractory tube material twice. In FIG. 1 a conventional heating element is illustrated. This two filament design electrically isolates filaments 1, 6 from each other by using a wall 5 dividing a refractory tube into two compartments. This design utilizes a reflective gold layer 4 on a rear surface 3 of a heat element tube in order to reflect energy through a forward surface 2 of the refractory tube. The same reflective gold layer is illustrated in FIG. 2 as 11. In this representation, a heating element utilizing a smaller internal isolating tube 10 within a larger refractory tube 7 electrically isolates two filaments 8, 9. Although this design may allow for an electrical cable to pass behind or within the smaller internal isolating tube, an annoying vibration often occurs with this design. Both of these prior art designs allow radiant energy to pass through a portion of the rear surface of these refractory tubes before the gold layer could reflect the energy back toward the front surface of the heating element. This involves a highly wasteful loss of energy that has been eliminated in the present invention, as illustrated in FIG. 3. In the present invention, there is no intervening tube wall between the highly reflective, highly insulated trough 14 and the filaments which are located within recessed portions along the length of the trough. The present invention directly reflects radiation from a filament to the reflecting trough wall and then towards transparent tube wall 12 thus greatly increasing efficiency. The energy loss associated with prior art utilization of a tube wall between the reflecting material and the radiation source has thus been eliminated with the use of the recent invention.

While it is apparent that the invention herein disclosed is well calculated to fulfill the objectives stated above, it will be appreciated that numerous modifications and embodiments may be devised by those skilled in the art. It is intended that the appended claims cover all such modifications and embodiments as fall within the true spirit and scope of the present invention.

We claim:

1. A heating element comprising:

a. a refractory member;

b. trough means oriented within a substantially hollow inner portion of said refractory member for reflecting and directing substantially all radiant energy directed toward it from at least one filament positioned therein to said refractory member, said trough means configured and adapted to precisely accommodate the shape of said at least one filament and to support each said at least one filament by contacting said at least one filament along substantially the entire length thereof within said refractory member, said trough means being made of a heat reflective and thermal insulating material; and c. at least one filament located directly upon and within said trough means for providing radiant energy to said refractory member;

wherein said radiant energy is reflected to and re-emitted by all surfaces of said refractory member not in contact with said trough means.

2. The heating element of claim 1 wherein said trough means is comprised of a heat reflecting and thermally insulating material.

3. The heating element of claim 1 wherein said trough means defines at least one recessed portion substantially parallel to a longitudinal axis of said trough means such that each said recessed portion contains one said filament.

4. The heating element of claim 1 wherein said at least one filament has a helical shape.

5. The heating element of claim 2 wherein the heat reflecting and thermally insulating material has a thermal conductivity of less than 0.35 $Wm^{-1} K^{-1}$.

6. The heating element of claim 5 wherein the heat reflecting and thermally insulating material has a thermal conductivity of less than 0.25 $Wm^{-1} K^{-1}$.

7. The heating element of claim 2 wherein the heat reflecting and thermally insulating material is comprised of ceramic fibres formed of alumina and silica.

8. The heating element of claim 2 wherein the heat reflecting and thermally insulating material is comprised of ceramic alumina fibers.

9. The heating element of claim 2 wherein the heat reflecting and thermally insulating material is comprised of ceramic silica fibers.

10. The heating element of claim 2 wherein the heat reflecting and thermally insulating material is comprised of silica obtained by means of slip casting.

11. The heating element of claim 1 wherein the refractory member is tubular in shape.

12. The heating element of claim 1 further comprising a metal rod located within said trough means, parallel to the longitudinal axis thereof, wherein said metal rod is electrically insulated from the at least one filament along substantially the entire length of said trough means.

13. A heating element comprising:

a. a tubular refractory member;

b. a trough oriented within said tubular refractory member for reflecting and directing substantially all radiant energy directed toward it from at least one filament positioned therein within said refractory member, said trough configured and adapted to precisely accommodate the shape of said at least one filament, said trough comprised of a thermally reflecting and thermally insulating material, said trough further comprising at least one recessed portion substantially parallel to a longitudinal axis thereof;

c. at least one helical filament adapted for providing radiant energy to said heating element, said at least one helical filament located within and supported by said at least one recessed portion along substantially the entire length within said trough; and d. a metal rod located within said trough parallel to said longitudinal axis of said trough and said metal rod electrically insulated from said at least one helical filament along substantially the entire length of said trough;

wherein said radiant energy is reelected to and reemitted by all surfaces of said refractory member not in contact with said trough.

14. The heating element of claim 13 wherein an internal electrical connection is made at a first end of said heating element between a first end of the metal rod and a first end of said at least one helical filament.

15. The heating element of claim 14 wherein a source of electricity is connected at one pole to a second end of the metal rod, and wherein said source of electricity is connected at an opposite pole to a second end of said at least one helical filament.

16. The heating element of claim 15 comprising two filaments wherein the source of electricity is connected at one pole to the second end of one filament, and at the opposite pole to the second end of the other filament.

17. The heating element of claim 14 wherein the refractory member is hermetically sealed at an end proximate to the internal electrical connection.

18. The heating element of claim 14 wherein said trough defines two parallel recessed portions, said two parallel recessed portions being substantially parallel to said longitudinal axis of said trough.

19. The tubular heating element of claim 13 wherein an end of the refractory tube proximate to the internal connection is hermetically sealed.

20. The heating element of claim 13 wherein said heat reflecting and thermally insulating material has a thermal conductivity of less than 0.35 $Wm^{-1} K^{-1}$.

21. A tubular heating element comprising:

a. a tubular refractive member;

b. trough means oriented within said tubular refractive member for reflecting and directing radiant energy from two filaments positioned therein to said refractory member, adapted to support each said two filaments within said tubular refractive member by contacting said two filaments along the entire length thereof, said trough means comprised of a heat reflecting and thermally insulating material with a thermal conductivity of less than 0.35 $Wm^{-1} K^{-1}$, said trough means defining two recessed portions substantially parallel to a longitudinal axis of said trough means to precisely accommodate the shape of said filaments; and c. two helical filaments adapted for providing radiant energy to said heating element, each said helical filament being located within one of said two recessed portions; and d. a metal rod aligned parallel to said longitudinal axis of said trough means and located within said trough means, said metal rod connected at an internal connection to said two helical filaments, wherein said radiant energy is reflected to and reemitted by all surfaces of said refractory member not in contact with said trough means.

22. The tubular heating element in claim 21 wherein an end of the refractory tube proximate to the internal connection is hermetically sealed.

23. The tubular heating element of claim 21 wherein the tubular refractive member has at least one substantially flat face, and wherein said recessed portions are open to reflect said radiant energy through substantially all of said flat face.

24. The tubular heating element of claim 23, wherein substantially all of said radiant energy is reflected and directed by said trough to one side of a plane passing longitudinally through said tubular refractive member.

25. The heating element of claim 1 wherein said trough means reflects and directs about 85 percent of said radiant energy.

26. The heating element of claim 13 wherein said trough means reflects and directs about 85 percent of said radiant energy.

* * * * *